US006279474B1

(12) United States Patent
Liebl

(10) Patent No.: US 6,279,474 B1
(45) Date of Patent: Aug. 28, 2001

(54) METHOD AND DEVICE FOR TRANSFERRING INK IN A PRINTING UNIT OF AN OFFSET PRINTING PRESS

(75) Inventor: Roland Liebl, Waghäusel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/418,372

(22) Filed: Oct. 13, 1999

Related U.S. Application Data

(63) Continuation-in-part of application No. 08/290,596, filed on Aug. 15, 1994, now abandoned.

(30) Foreign Application Priority Data

Aug. 13, 1993 (DE) ..... 43 27 212

(51) Int. Cl.[7] ..... B41F 31/00; B41K 1/38

(52) U.S. Cl. ..... 101/351.8; 101/483; 101/349.1; 101/327

(58) Field of Search ..... 101/351.8, 483, 101/494, 211, 365, 366, 349.1, FOR 100, 348–350.3, 352.06, 364–367, 177, 205, 206, 217, 492, 327; 347/6, 54, 29, 12, 13, 37, 40, 42

(56) References Cited

U.S. PATENT DOCUMENTS

| | | | | |
|---|---|---|---|---|
| 3,142,246 | * | 7/1964 | Ross | 101/76 |
| 3,898,670 | | 8/1975 | Erikson et al. . | |
| 4,332,196 | | 6/1982 | Braun . | |
| 4,729,310 | | 3/1988 | Love, III . | |
| 5,007,341 | * | 4/1991 | Nakano et al. | 101/349 |
| 5,072,671 | | 12/1991 | Schneider et al. . | |
| 5,154,121 | | 10/1992 | Schneider . | |

FOREIGN PATENT DOCUMENTS

| | | |
|---|---|---|
| 2 251 657 | 5/1974 | (DE) . |
| 29 51 651 A1 | 7/1981 | (DE) . |
| 29 51 651 C2 | 7/1981 | (DE) . |
| 38 37 898 A1 | 6/1990 | (DE) . |
| 41 19 111 A1 | 12/1992 | (DE) . |
| 0 126 479 A2 | 11/1984 | (EP) . |
| 0 516 041 A1 | 12/1992 | (EP) . |
| 0 530 627 A2 | 3/1993 | (EP) . |

OTHER PUBLICATIONS

International Publication No. WO 93/07000 (Landa), dated Apr. 15, 1993.

* cited by examiner

*Primary Examiner*—Kimberly Asher
(74) *Attorney, Agent, or Firm*—Herbert L. Lerner; Laurence A. Greenberg; Werner H. Stemer

(57) ABSTRACT

Method for metered transferring of ink to an ink roller in a printing unit of a rotary offset printing press, wherein the ink is applied under pressure to a casing surface of the ink roller, includes determining digital data for effecting a two-dimensional ink distribution on the casing surface corresponding to an ink consumption. The ink is ejected in droplets from an ink-jet unit to the ink roller. The ink-jet unit has nozzles which are aligned with one dimension of the two-dimensional ink distribution. The ink-jet nozzles of the ink-jet unit are controlled by a control device in accordance with the digital data.

21 Claims, 11 Drawing Sheets

| | A | B | C | D | E | F | G | H | I | J | K | L | M | N | O |
|---|---|---|---|---|---|---|---|---|---|---|---|---|---|---|---|
| R | 0 | 0 | 0 | 0 | 0 | 0 | 0 | 0 | 0 | 0 | 0 | 0 | 0 | 0 | 0 |
| Q | 0 | 0 | 0 | 0 | 0 | 0 | 0 | 0 | 0 | 0 | 0 | 0 | 0 | 0 | 0 |
| P | 0 | 0 | 0 | 0 | 0 | 0 | 0 | 0 | 0 | 0 | 0 | 0 | 0 | 0 | 0 |
| O | 0 | 0 | 1 | 1 | 1 | 1 | 1 | 1 | 1 | 1 | 0 | 0 | 0 | 0 | 0 |
| N | 0 | 0 | 1 | 1 | 1 | 1 | 1 | 1 | 1 | 1 | 0 | 0 | 0 | 0 | 0 |
| M | 0 | 0 | 1 | 1 | 1 | 1 | 1 | 1 | 1 | 1 | 0 | 0 | 0 | 0 | 0 |
| L | 0 | 0 | 1 | 1 | 1 | 0 | 0 | 0 | 0 | 0 | 0 | 0 | 0 | 0 | 0 |
| K | 0 | 0 | 1 | 1 | 1 | 0 | 0 | 0 | 0 | 0 | 0 | 0 | 0 | 0 | 0 |
| J | 0 | 0 | 1 | 1 | 1 | 0 | 0 | 0 | 0 | 0 | 0 | 0 | 0 | 0 | 0 |
| I | 0 | 0 | 1 | 1 | 1 | 0 | 0 | 0 | 0 | 0 | 0 | 0 | 0 | 0 | 0 |
| H | 0 | 0 | 1 | 1 | 1 | 0 | 0 | 0 | 0 | 0 | 0 | 0 | 0 | 0 | 0 |
| G | 0 | 0 | 1 | 1 | 1 | 0 | 0 | 0 | 0 | 0 | 0 | 0 | 0 | 0 | 0 |
| F | 0 | 0 | 1 | 1 | 1 | 0 | 0 | 0 | 0 | 0 | 0 | 0 | 0 | 0 | 0 |
| E | 0 | 0 | 1 | 1 | 1 | 0 | 0 | 0 | 0 | 0 | 0 | 0 | 0 | 0 | 0 |
| D | 0 | 0 | 1 | 1 | 1 | 0 | 0 | 0 | 0 | 0 | 0 | 0 | 0 | 0 | 0 |
| C | 0 | 0 | 1 | 1 | 1 | 0 | 0 | 0 | 0 | 0 | 0 | 0 | 0 | 0 | 0 |
| B | 0 | 0 | 1 | 1 | 1 | 0 | 0 | 0 | 0 | 0 | 0 | 0 | 0 | 0 | 0 |
| A | 0 | 0 | 0 | 0 | 0 | 0 | 0 | 0 | 0 | 0 | 0 | 0 | 0 | 0 | 0 |

Fig.8

METHOD AND DEVICE FOR TRANSFERRING INK IN A PRINTING UNIT OF AN OFFSET PRINTING PRESS

CROSS-REFERENCE TO RELATED APPLICATION

This is a continuation-in-part of application Ser. No. 08/290,596, filed Aug. 15, 1994 now ABN.

BACKGROUND OF THE INVENTION

Field of the Invention

The invention relates to a method for the metered transfer of ink onto an ink roller in a printing unit of a rotary offset printing press, wherein the ink is applied under pressure to the casing surface of the ink roller. The invention further relates to a device for performing the method.

It has become known heretofore from the published German Patent Document DE 29 51 651 A1 to apply printing ink in a printing unit metered by pump pressure onto an ink roller of an inking unit by means of ink nozzles. Such a device replaced conventional devices for applying ink, wherein an ink duct roller is supplied with ink from an ink duct. In both cases, the ink applied to the ink roller is then distributed in a printing unit, which is formed of many ink rollers and consequently expensive, until a required quantity in a layer of predetermined thickness is attained on a form or application roller which deposits the ink on a blanket cylinder in an offset printing press. Devices according to the foregoing patent publication do not measure up to the requirements as to quality imposed on offset printing.

SUMMARY OF THE INVENTION

It is accordingly an object of the invention to provide a method and device for transferring ink in a printing unit of an offset printing press wherein the two-dimensional ink profile required for printing in an offset printing press is applied to an ink roller with an as exactly as possible metered ink quantity, in order thereby to reduce the expense for conventional inking units.

With the foregoing and other objects in view, there is provided, in accordance with the invention, a method for metered transferring of ink to an ink roller in a printing unit of an offset printing press, wherein the ink is applied under pressure to a casing surface of the ink roller, which comprises determining digital data for effecting a two-dimensional ink distribution on the casing surface corresponding to an ink consumption, and ejecting ink droplets for applying ink to the ink roller from at least one nozzle of an ink-jet unit controlled by means of a control device in accordance with the digital data.

In accordance with another aspect of the invention, there is provided a device for metered transferring of ink to an ink roller in a printing unit of an offset printing press, comprising a computer having an input for digital data for producing printing plates by effecting a two-dimensional ink distribution on a casing surface of the ink roller corresponding to an ink consumption, and an ink-jet unit with capillary nozzles connected to the computer so as to be electronically controllable by the computer for ejecting ink droplets for applying ink to the ink roller in accordance with the digital data.

In accordance with another feature of the invention, the ink roller is an inking roller disposed in rolling contact with an ink form roller for transferring onto the ink form roller ink applied directly to the inking roller from the capillary nozzles of the ink-jet unit.

In accordance with a concomitant feature of the invention, the ink roller is an ink form roller disposed adjacent to the capillary nozzles of the ink-jet unit wherefrom ink is applied directly onto the ink form roller.

The application or use of the general principle widely known with regard to ink-jet printers, wherein liquid ink is ejected from continuously open capillary tubes either by a very high pressure or in an electrophysical manner permits a very precise metered ink transfer both in breadthwise, i.e., lengthwise, direction of the respective ink roller, as well as in circumferential direction thereof, suitable digital data being derivable from data determined for a printing form and being in part directly applicable, respectively.

A conventional inking unit formed of several rollers is entirely or to a considerable extent replaced by an ink-jet unit when applying the method according to the invention, the ink-jet unit, if necessary or desirable, being a customary ink-jet printer with a conventional computer control. Considerable costs for the production of an inking unit are thereby avoided.

Because the length of the transfer path of the ink in a printing unit according to the invention is very short, the inking unit reacts rapidly to required variations in the ink application or deposition on a printing form. Furthermore, waste or spoilage can be reduced during proof printing, because the operation of letting the printing ink run in requires a considerably shorter time than for conventional expensive inking units having many ink-unit rollers. Whereas only one-dimensional zonal ink key presetting values are provided over the breadth or length of a cylinder in conventional methods of presetting the inking unit, according to the invention of the instant application, two-dimensional ink key presetting values are employed by which, during the application or deposition of the ink, the ink consumption dependent upon the printed image is taken into account.

Thus, provided in accordance with the invention of the instant application is an ink jet apparatus with capillary nozzles directed to an ink roller transferring the ink directly to the ink form roller which surrenders the ink to the plate cylinder. In particular cases, the capillary nozzles of the ink-jet apparatus can also be directed directly to an ink form cylinder which transfers or applies the ink onto the plate cylinder. It is conducive to a further reduction in cost that the manufacturing tolerances for ink-jet apparatuses for performing the method according to the invention can be greater than for ink-jet printers. The number of capillary nozzles does not have to be as great as for printers in order to achieve the objectives striven for with the invention.

With the above and other objects in view there is also provided, in accordance with the invention, a method for inking a printing form on a cylinder of a rotary offset printing press, having an inking system with an inking roller and an ink-jet printing apparatus acting across a length of the inking roller, wherein a number of ink drops that can be expelled per unit of length onto the surface of the inking roller with the ink-jet printing apparatus is substantially less than a number of screen dots generated per unit of length on the printing form, the method which comprises:

- inputting into a control device signals containing an ink quantity V output per area element of a printing form onto an offset cylinder;
- ejecting ink drops from ink-jet nozzles of the ink-jet printing apparatus under control of the control device;
- applying a quantity V of ink from the ink-jet nozzles to area elements of the surface of the inking roller corresponding to the ink quantity V output to the corresponding area element of the offset cylinder; and renewing the ink quantity output to the offset cylinder in each area element during a revolution of the printing form cylinder.

In two alternative embodiments, the inking roller is an ink form roller in rolling contact with the printing form, or the inking roller is in rolling contact with an ink form roller that is in rolling contact with the printing form.

There is also provided, in accordance with the invention, a method for inking a rotating printing form having a printing form surface being imaged with screen dots carrying ink during printing, which comprises:

defining a plurality of screen dots within a specific one of a plurality of area elements dividing a printing form surface;

applying ink with an inking roller having a roller surface divisible into area elements corresponding to the area elements of the printing form;

expelling ink drops with an ink jet unit onto the inking roller, and applying a volume of the ink to the specific area element of the inking roller equivalent to an ink volume transferred away from the specific area element of the printing form in printing;

wherein the ink drops are applied by the ink jet unit onto the specific area element of the inking roller in a number substantially less than a number of screen dots located within the specific element of the printing form.

In accordance with another feature of the invention, which is applicable to the first embodiment in which the inking roller is an ink form roller rolling on the printing form, the ink is transferred directly with the one specific area element.

In accordance with an alternative embodiment, the ink is transferred to the specific area element of the printing form indirectly via the ink form roller.

In accordance with again a further feature of the invention, the ink jet unit applies variously metered volumes of ink on respective area elements of the inking roller, to compensate for a local ink output of the inking roller varying from one area element to another during printing.

In accordance with again another feature of the invention, the volumes of ink are metered to vary in size from one area element of the inking roller to another and the ink is expelled in a different drop size for each of the area elements.

In accordance with yet an added feature of the invention, a single drop of ink is applied to each of the area elements.

In accordance with yet an additional feature of the invention, the method comprises metering the volumes of ink to vary in size from one area element of the inking roller to another and expelling the ink in a different number of drops, greater in each case than zero, for each of the area elements.

In accordance with yet another feature of the invention, the same volume of ink is applied with the ink-jet unit to the specific area element of the inking roller after each revolution of the printing form.

In accordance with yet a further feature of the invention, the printing form is a planographic printing form, in particular an offset printing form.

In accordance with yet again a further feature of the invention, a number of screen dots in the specific area element of the printing form is at least 10 times a number of ink drops by the ink jet unit to the specific area element. In preferred embodiments of the invention, the number of dots is at least 20 times, 50 times, or 100 times the number of ink drops ejected by the ink-jet nozzles.

In accordance with yet again an added feature of the invention, ink is supplied to the printing form for printing exclusively with the ink jet unit.

In accordance with yet again an additional feature of the invention, the inking roller is an ink form roller, and the method comprises placing the roller in rolling contact with at least one axially oscillating vibrator roller, downstream of the ink jet unit and upstream of the printing form in a direction of rotation of the ink form roller, and spreading the ink drop with the vibrator roller after applying the ink drop to the ink form roller with the ink jet unit prior to transferring the ink to the printing form.

In accordance with a concomitant feature of the invention, the inking roller is rotated in rolling contact with an ink form roller, the ink form roller being in rolling contact with at least one axially oscillating vibrator roller disposed downstream of the inking roller and upstream of the printing form in a direction of rotation of the ink form roller, and the method which comprises spreading the ink drop applied by the ink jet unit to the inking roller and transferred from the inking roller to the ink form roller, by friction before transferring the ink drop to the printing form.

Thus the very high print quality intrinsic to offset printing and the economical use of ink intrinsic to the ink-jet method can be attained simultaneously.

The data transfer for driver control of the ink-jet apparatus is considerably less than for conventional ink-jet printers. Relatively few kilobytes kB of data per page of A-4 paper size (German Industrial Norm DIN A-4, 210×297 mm) are sufficient compared with many megabytes MB for the conventional ink-jet printers. The digital data necessary for controlling the ink-jet apparatus are readily derivable from the digital data which are determined in modern printing presses for the production of printing forms, such as printing plates, for example, or which are obtained from scanning a sample copy by means of an image exposure or photographic device.

Other features which are considered as characteristic for the invention are set forth in the appended claims.

Although the invention is illustrated and described herein as embodied in a method and device for transferring ink in a printing unit of an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWINGS

FIG. 8 is a bitmap containing data for printing images on the printed image region of the printing form;

DESCRIPTION OF THE PREFERRED EMBODIMENTS

Figure 1:
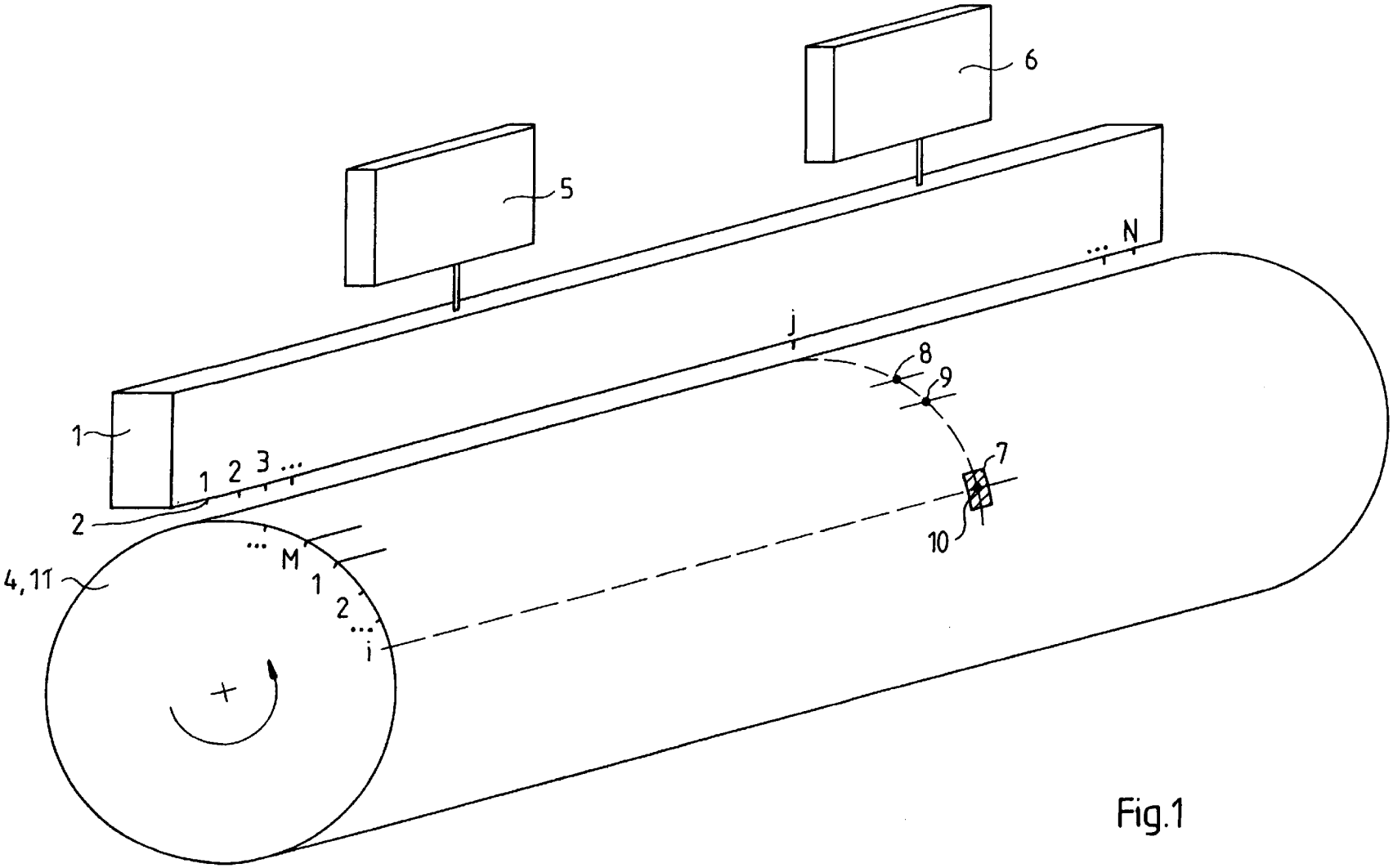
FIG. 1 is a diagrammatic perspective view of an ink transferring device according to the invention in the form of an ink-jet unit in combination with an inking roller.

Referring now to the drawings and, first, particularly to FIG. 1 thereof, there is shown therein an ink-jet unit 1 having nozzles 2 arranged along a line extending parallel to the rotational axis 3 of an inking roller 4. The ink-jet unit 1 is connected to a control device 5 and a unit 6 for supplying ink.

Figure 4:
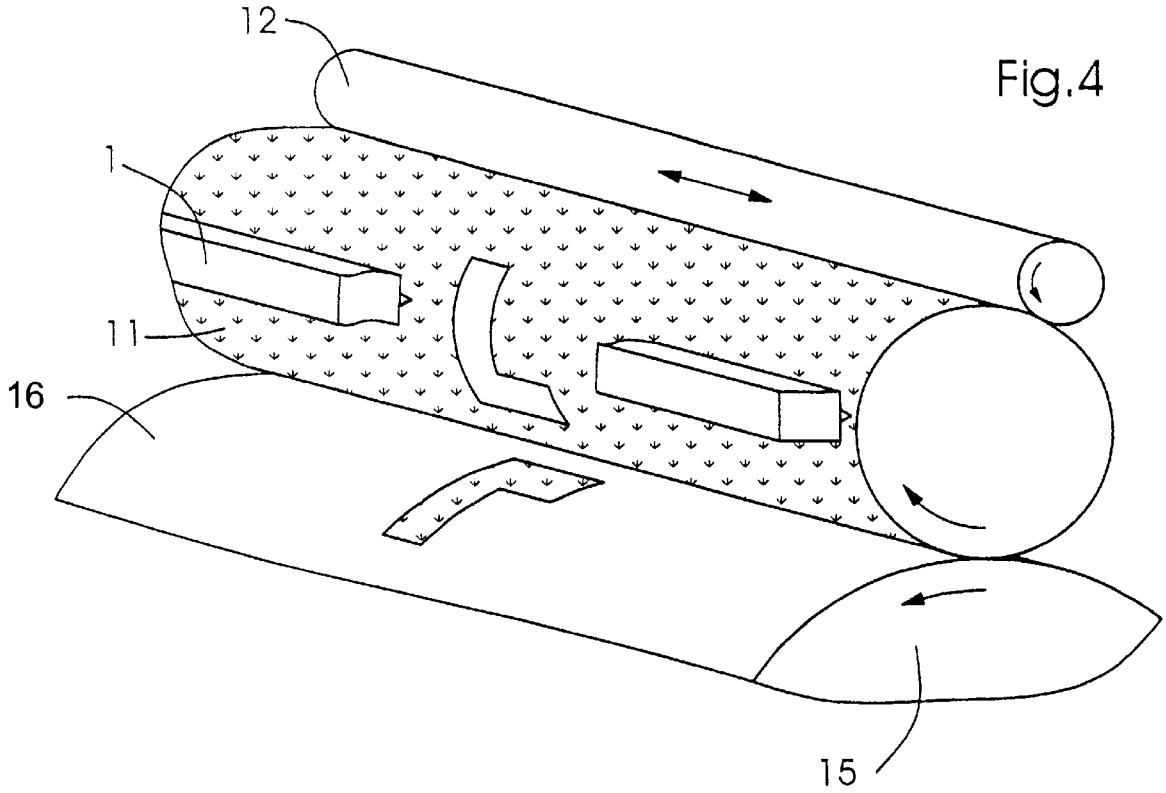
FIG. 4 is a diagrammatic perspective view of the ink form roller of FIG. 3, shortly after its local transfer of ink to a printed image region of a printing form.

The transfer or application of ink onto the inking roller 4 occurs as follows:

Individual ink drops 8, 9, 10 are produced by the ink-jet unit 1 for each rotation of the inking roller 4 and are applied in screen tint area elements 7 to the surface of the inking roller 4. As shown in FIG. 4, the area elements 7 of rectangular shape are provided in circumferential direction M and in lateral direction N of the inking roller 4. The area elements 7 are relatively small, for example, having a side length n smaller than 0.1 mm. A defined number of ink drops 8, 9, 10 are applied to each area element 7, the respective applied quantity of ink per area element 7 constituting a defined volume V(i,j). The volume V(i,j) for an area element 7 is controlled by means of a control device 5, so that the following equation is fulfilled:

$$V(i,\ j) = \int_{A(i,j)} [s - s(x,\ y)]\, dx dy$$

With the following formal definitions:

$x_0=0$ and $x_i=x_{i-1}+X/M$ for i=1, 2, 3, . . . M $x_0=0$ and $y_j=x_{j-1}+Y/M$ for j=1, 2, 3, . . . N, the result is $$V(i,\ j) = \int_{y_{j-1}}^{y_j} \int_{x_{i-1}}^{x_i} [s - s(x,\ y)]\, dx dy$$

wherein s represents the ideal desired ink layer thickness on an ink form roller 11 (FIGS. 2 and 3) and s(x,y) represents the actual ink layer thickness on the ink form roller 11 in one area element (i,j) once the inking of the printing plate and ink transfer from the area element (i,j) to the printing plate has been done. The expression or term [s—s(x,y)] describes the ink requirement of a printing form 16 in its printing regions and is known for digitally produced printing forms. The term [s—s(x,y)] corresponding exactly to the control data used in the digital exposure of the printing form to light in the appropriate region thus has only two values. Either it is zero, or it assumes the value of a constant, which is dependent on the requisite ink film thickness on the printing form.

Figure 2:
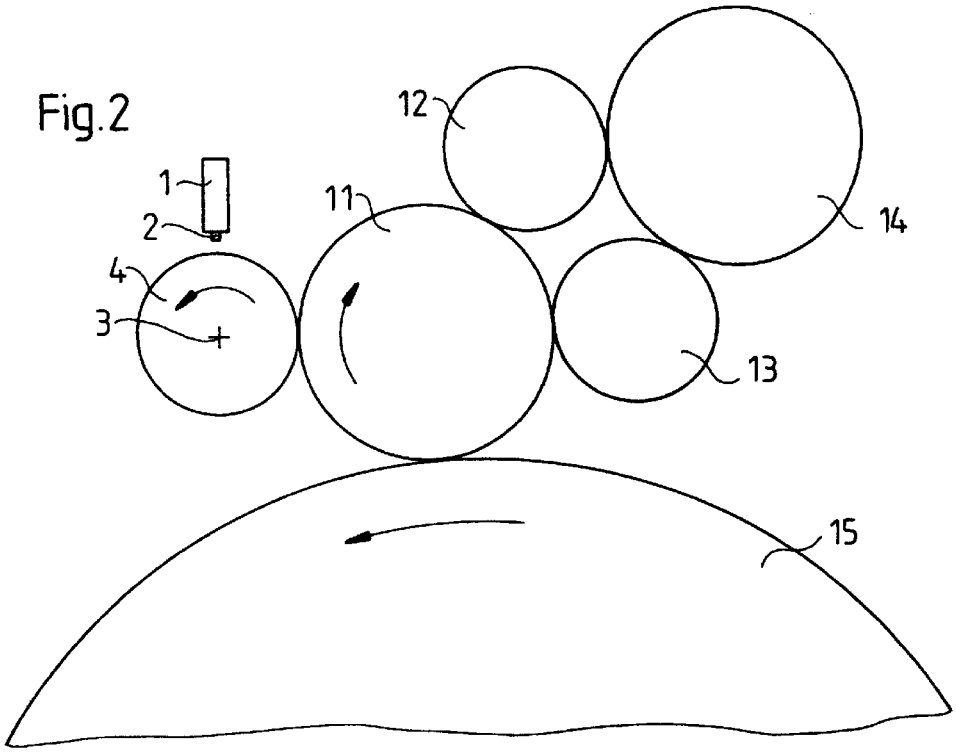
FIG. 2 is a diagrammatic end view of an inking unit with an inking roller according to FIG. 1 and a form roller.
Figure 3:
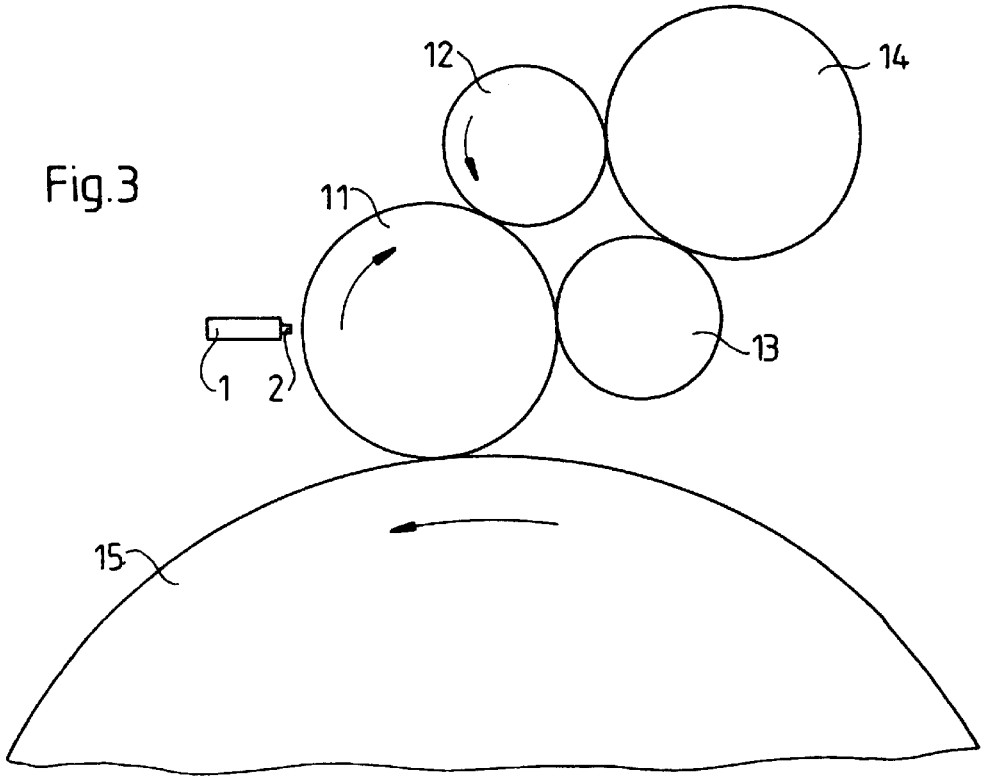
FIG. 3 is a view like that of FIG. 2 showing the ink-jet unit in combination with a form roller, the inking roller of FIG. 1 having been omitted.

The manner in which the method of transferring or applying ink as performed in accordance with the invention is illustrated in FIGS. 2 and 3. In addition to the ink-jet unit 1 and the inking roller 4 provided in the printing unit shown in FIG. 2, an ink form roller 11 and ink rollers 12, 13, 14 which are, respectively, in rolling contact with one another, are also included in the printing unit. The ink form roller 11 is disposed in contact with a plate cylinder 15. The inking roller 4 has a smaller diameter than that of the ink form roller 11. The ink form roller 11 transfers part of the ink which has been applied thereon to the plate cylinder 15. The part of the ink transferred to the plate cylinder 15 is renewed by the inking roller 4, new ink being applied to the inking roller 4 by means of the ink-jet unit 1 in accordance with or depending upon the image being printed in the afore-described manner. The ink rollers 12, 13, and the inking roller 14, embodied as axially oscillating vibrator rollers, have an auxiliary function. They assist in the distribution of the ink within the area elements (i,j) by smoothing out the respective elemental quantities of ink applied to the surface of the ink form roller 11.

In the other embodiment of the device according to the invention shown in FIG. 3, the ink is directly applied to the surface of the ink form roller 11 by the ink-jet unit 1, the inking roller 4 of the embodiment of FIG. 2 having been omitted entirely, which minimizes the expense of producing the device even further.

On the basis of this exemplary embodiment, the method of the invention will now be explained once again in detail.

In FIG. 4, the inking unit shown in FIG. 3 is shown from a lateral perspective, so that an L-shaped well in plan view can be seen in the otherwise uniformly thick ink film on the ink form roller 11. The ink torn out of the ink film in the region of the originally filled well upon ink application from a printing form 16 spread onto the plate cylinder 15 occupies a printing region on the circumferential surface of the printing form 16, whose developed view is the mirror image of the developed view of the well, and which is surrounded by a non-printing region, not shown in shaded fashion.

The well has formed from the flowing of ink out of many tiny indentations that the screen dots of the printing region have is left behind in the ink film.

Figure 5:
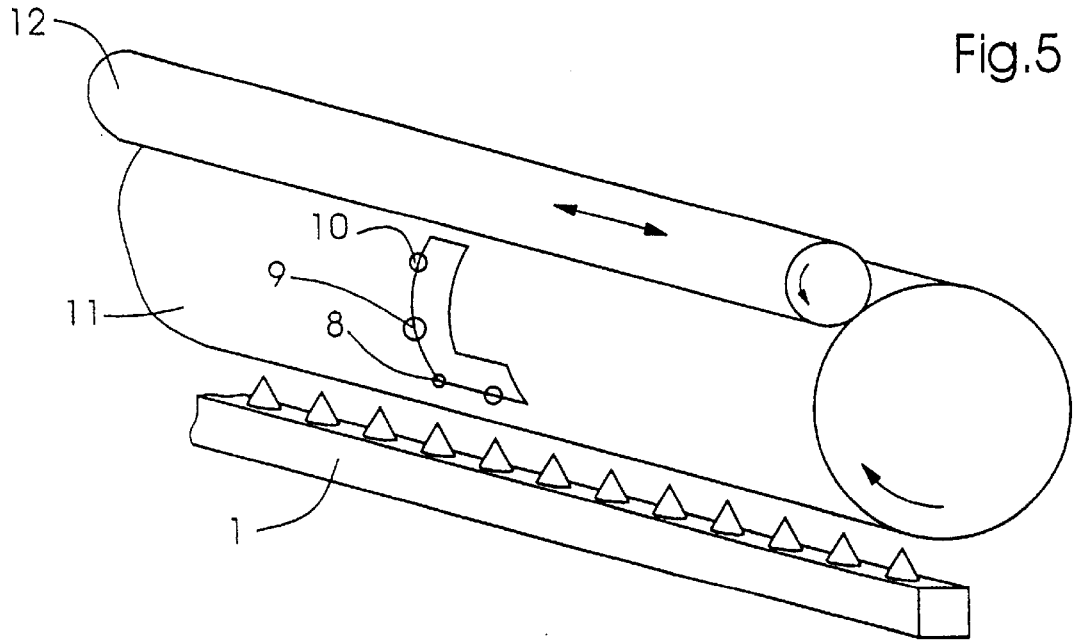
FIG. 5 is a diagrammatic perspective view of the ink form roller shortly after ink drops have been applied to it by means of the ink jet unit to replace the ink that has been output.

In FIG. 5, the inking unit is shown in a plan view. In a manner to be explained hereinafter in conjunction with FIG. 7, a plurality of ink drops 8, 9 and 10, whose individual volumes taken together are equivalent to the ink volume torn out of the well, had been sprayed in the region of the well with the aid of the ink jet unit 1 onto the ink form roller 11, which has rotated onward compared to the rotary angle position shown in FIG. 4.

Figure 6:
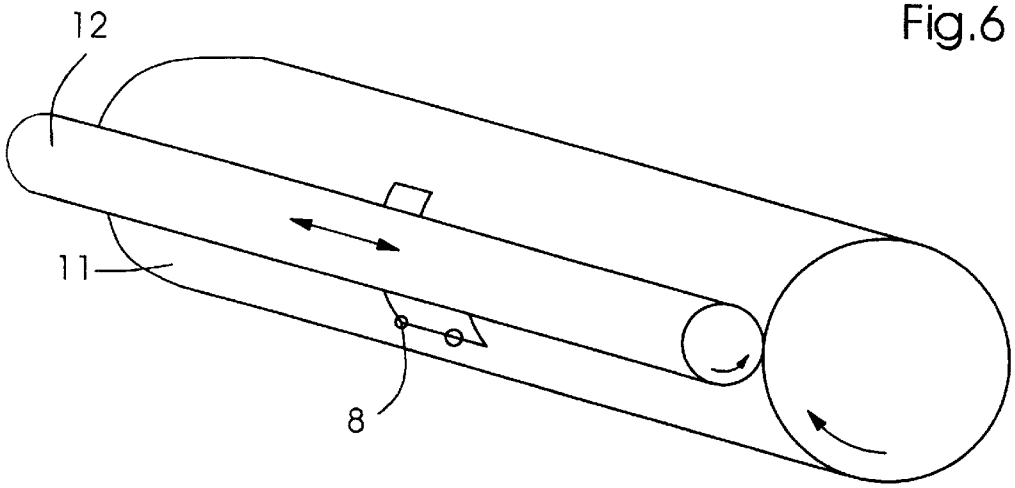
FIG. 6 is an illustration of the ink drops applied, which have already been partly spread by an inking roller of the inking unit.

In FIG. 6, the inking unit is again shown in a plan view, from a different angle then in FIG. 5. The ink form roller 11 has rotated onward out of its rotary angle position shown in FIG. 5 to a rotary angle position in which the well has already partly passed through a compression gap formed by the rubber-elastically coated ink form roller 11 together with the inking roller 12 oscillating in its axial direction. Because of the well and the sometimes raised drops 8 located in it, the ink film on the ink form roller 11 still has a very uneven film surface when it enters the compression gap; in the compression gap, because the drops that are flowing apart from one another are spread by friction in the axial direction, and the drops 8 that fill the well are rolled flat in the circumferential direction, this uneven film surface is evened out, so that the ink film emerging from the compression gap has the original, uniform ink film thickness at every point, including in the region of the well. To prepare the film surface for another rolling contact with the printing form 16, a single pass through the compression gap is sufficient.

Figure 7:
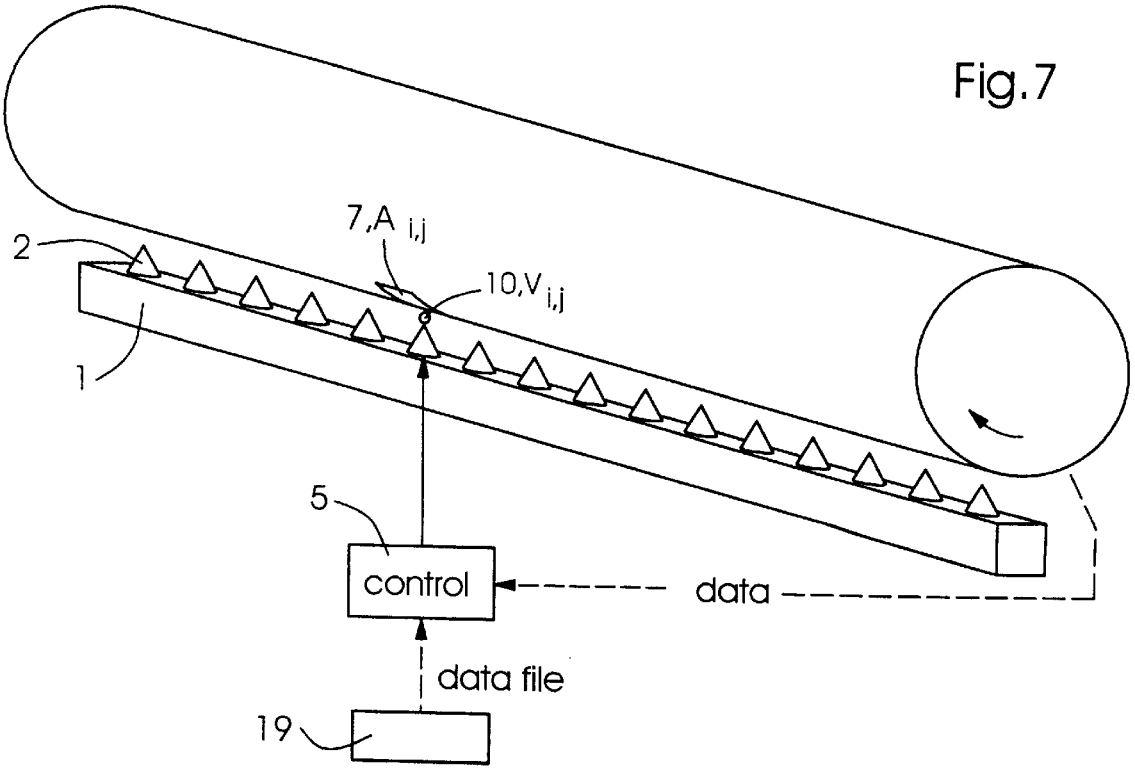
FIG. 7, the ink jet unit upon application of one of the ink drops to the ink form roller.

In FIG. 7, it is schematically shown that the control device 5, which is embodied as a computer with a microprocessor, synchronizes the data for the drops 8, 9 and 10 with the applicable current rotary angle position of the ink form roller 11. As a result, the control device 5 on the one hand is continuously furnished with data representing the instantaneous rotary angle positions, from an incremental transducer coupled with the ink form roller 11, such as a tachometer rotating with the ink form roller 11, and on the other hand, data representing the requisite volumes of the individual drops 8, 9 and 10 and calculated in accordance with the equation indicated above in a computer 19 that also includes a microprocessor are written in via a data line or a portable data medium, so that the control device 5 can assign one or more drops 8, 9 and 10 of a specific volume $V_{i,j}$ to each area element $A_{i,j}$ on the ink form roller 11.

In FIG. 8, a bitmap produced by a screen image processor is shown, whose control data are used by a plate exposing means or by an image printing device integrated with the printing press for digital image printing of the printing form 16 by laser exposure pixel by pixel. The value "0" stands for "no exposure", and the value "1" stands for "exposure", at the applicable point of a screen matrix shown in part here that is determined by the coordinates A-O and R-A; the printing screen dots 17 are disposed on the printing form in this screen. This screen can be called a screen dot matrix.

Figure 9:
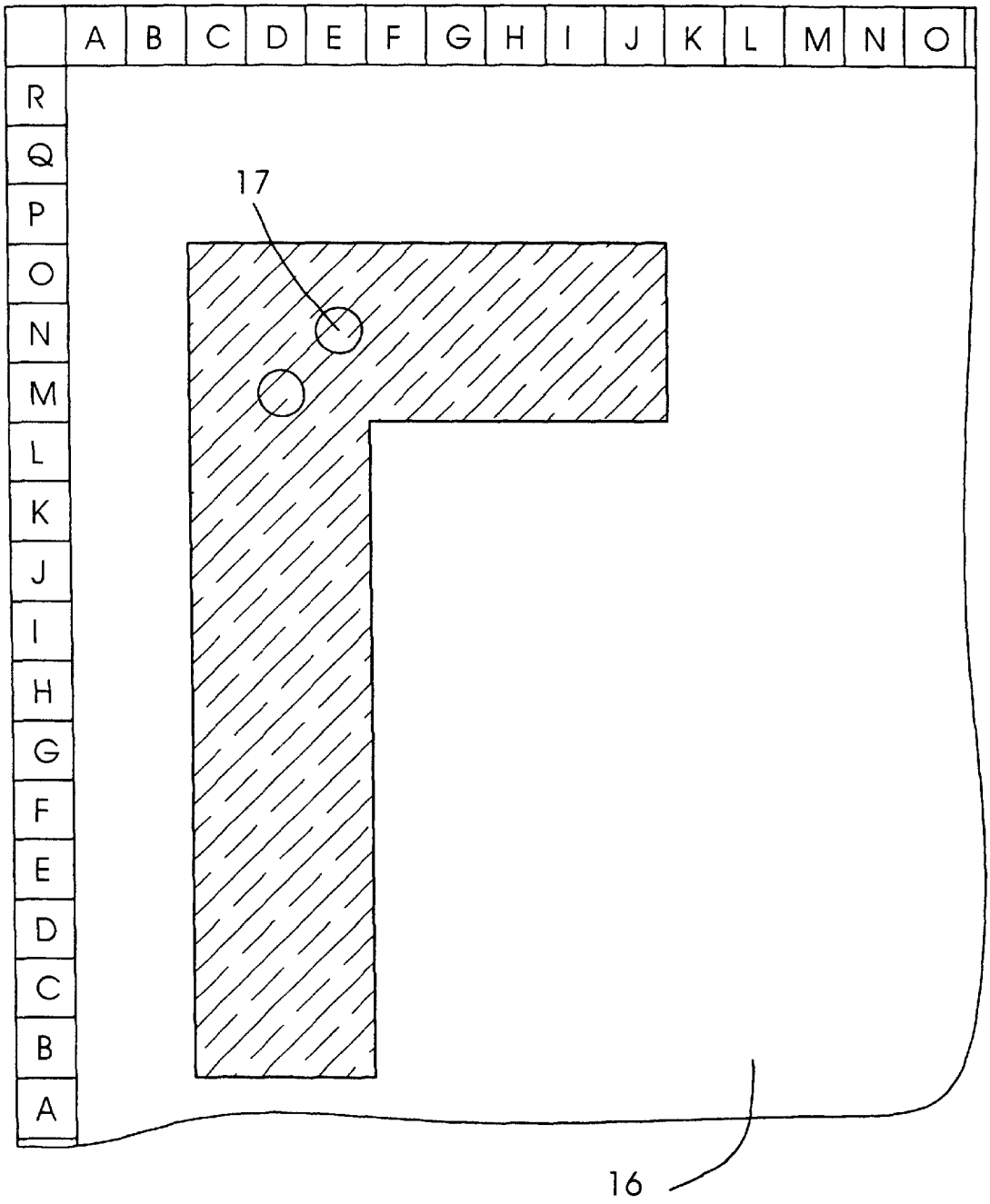
FIG. 9 is the corresponding printed image region in an enlarged view compared with FIG. 4.

In FIG. 9, the printing region already shown in FIG. 4 is shown enlarged and in a developed view along with the coordinates of the screen dot matrix.

The printing region shown shaded is composed of many screen dots 17, produced in the image printing of the printing form in accordance with the bitmap; this is indicated in fragmentary form by two screen dots. To simplify the explanations that follow, the screen dots 17 have been combined into an L-shaped region corresponding to the area of their entirety.

Figure 10:
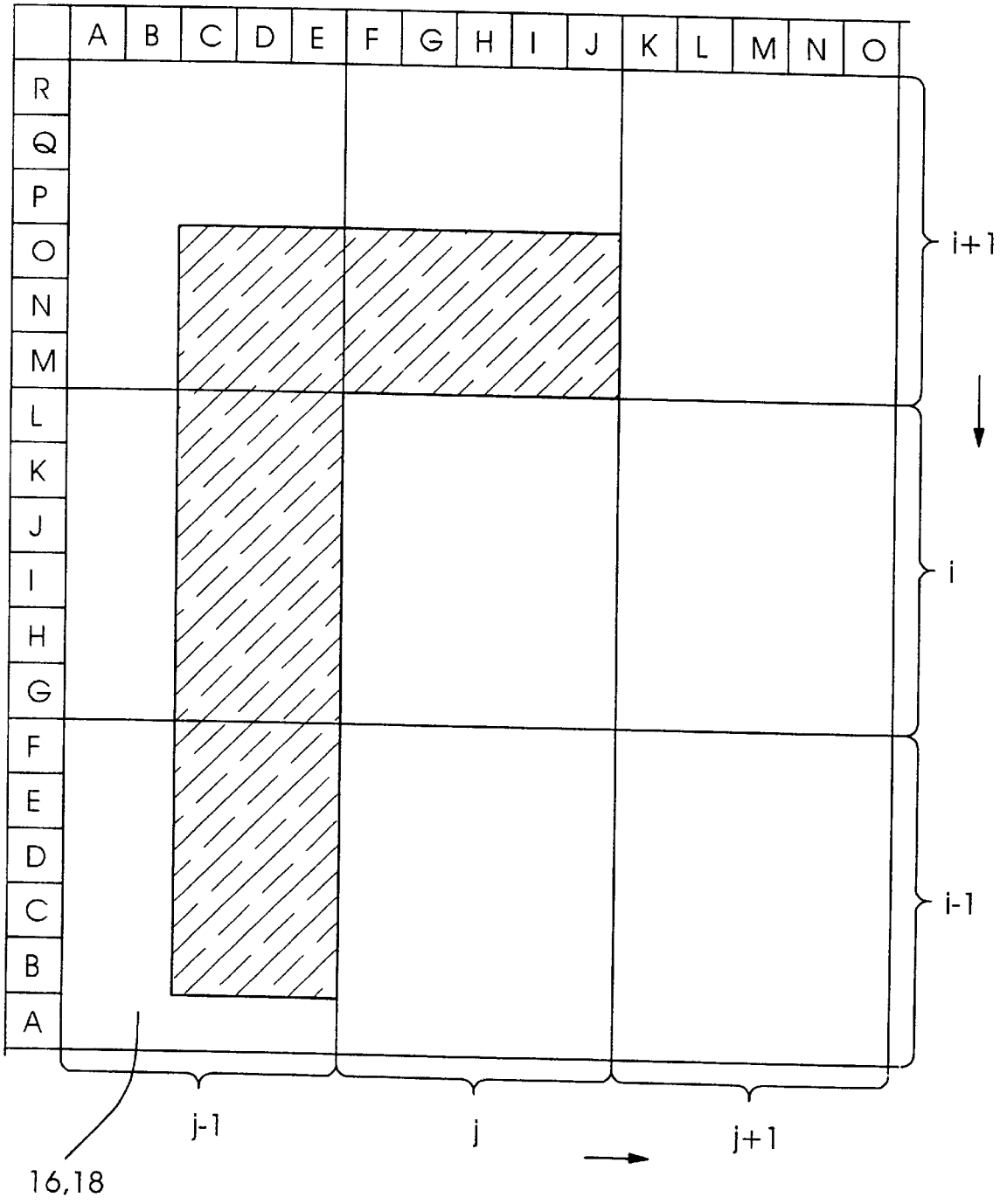
FIG. 10 is a view of the printed image region of FIG. 9, shown schematically with reference to a subdivision of the surface of the printing form into identical area elements or fields.
Figure 11:
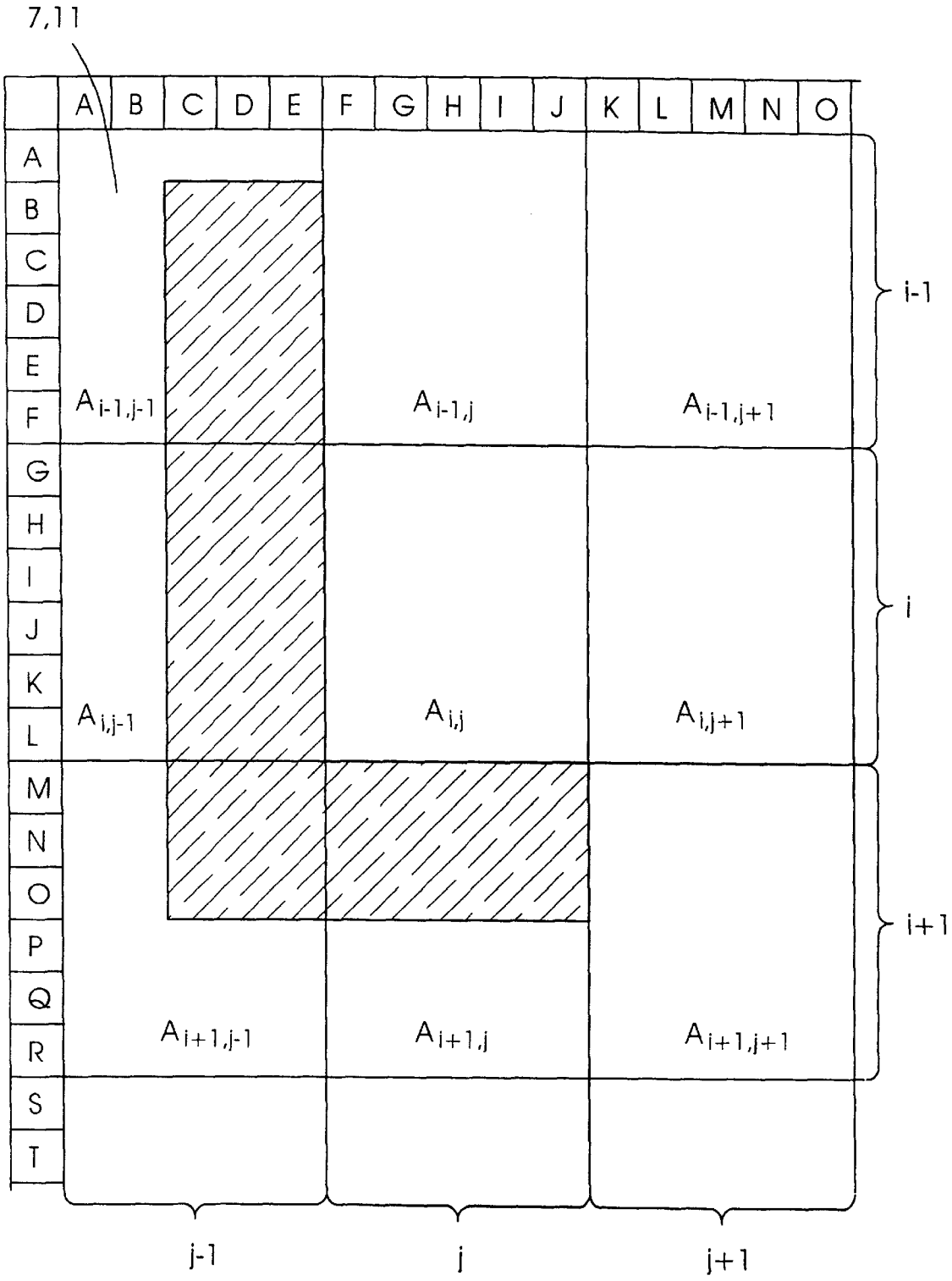
FIG. 11 is a screen on which the triggering of the ink jet unit is based and which is shown together with identical fields into which the circumferential surface of the ink form roller is subdivided.

In FIG. 10, the printing region of FIG. 9 is shown again with an imaginary screen matrix over it, the printing form surface being subdivided into its rectangular area elements 18; this screen is much coarser than the screen dot matrix. The area elements 18 agree in shape with area elements 7 of a screen, shown in fragmentary form in FIG. 11 and hereinafter called the ink-jet screen, of the developed ink form roller 11, which is shown again in FIG. 15 with all its area elements 7, $A_{i,j}$ and is provided with the requisite variable and coordinate designations for the integrative calculation of the volumes $V_{i,j}$; x and y are the coordinates in the circumferential and lateral direction, each for one rectangular area element.

Upon passing through a compression gap formed by the ink form roller 11 together with the printing form 16, the area element 19 rolls precisely congruently over the area element 18. The existing mirror symmetry of the printing region of the printing form 16 and of the well to be filled in the ink film on the ink form roller 11 has been taken into account by means of the contrary course of the coordinates A-R in FIG. 11 and I-A in FIG. 10 extending in the circumferential directions.

The screen row spacing of the screen determining the area elements 7 and 18 of the printing form 16 and the ink form roller 11 is a multiple, both in the circumferential and the lateral directions, of the screen row spacing of the screen dot matrix that determines the location of the screen dots 17.

In the exemplary embodiment shown, the ink-jet screen is selected such that five screen or exposure dots 17 in the lateral direction and six screen or exposure dots 17 in the circumferential direction each correspond to one area element 7 or $A_{i,j}$ acting as an addressing point for the ink-jet unit 1. Although the plate exposing means that is used to print images on the printing form 16 has a comparatively high resolution, in this example 2400 dpi in each of the two directions, the resolution of the ink jet unit in the lateral direction needs to be only 480 dpi and in the circumferential direction only 400 dpi.

On the basis of the bitmap—see FIG. 8—the computer 20 calculates the ink demand for each area element 7 or $A_{i,j}$ of the ink form roller 11 from the area coverage 11 of the area element 18 of the printing form that corresponds to the area is element 7, or in other words from the number of screen dot positions of the area element 18 that are actually each occupied by one screen dot; this number is referred to the number of all the existing or in other words unoccupied screen dot positions of the area element 18.

Figure 12:
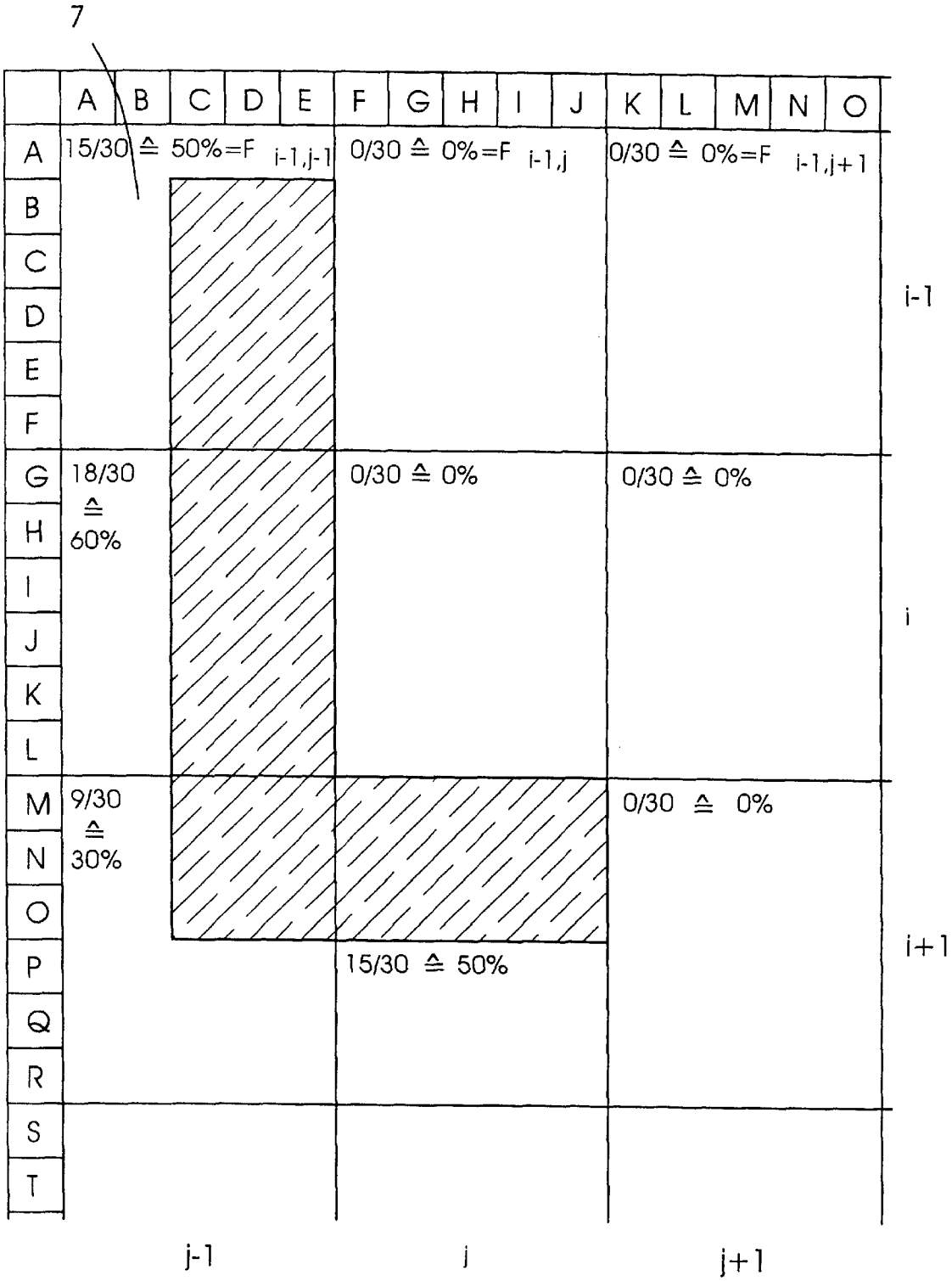
FIG. 12 is a schematic view of the ink-jet screen of FIG. 11, with mean area coverage values shown for the individual fields.
Figure 13:
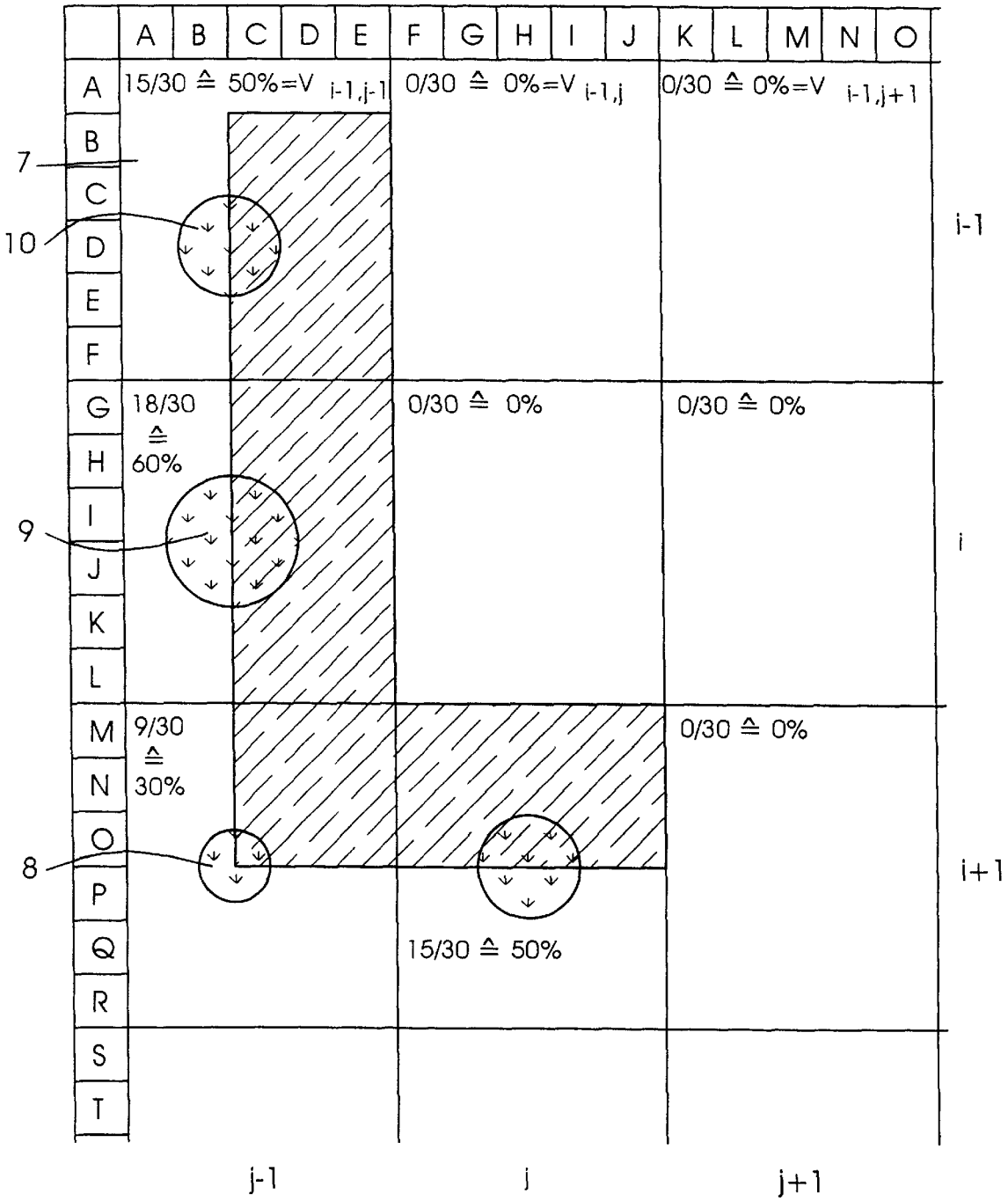
FIG. 13 a schematic view of the circumferential surface of the ink form roller with the ink drops of different sizes applied in its fields by the ink jet unit.
Figure 14:
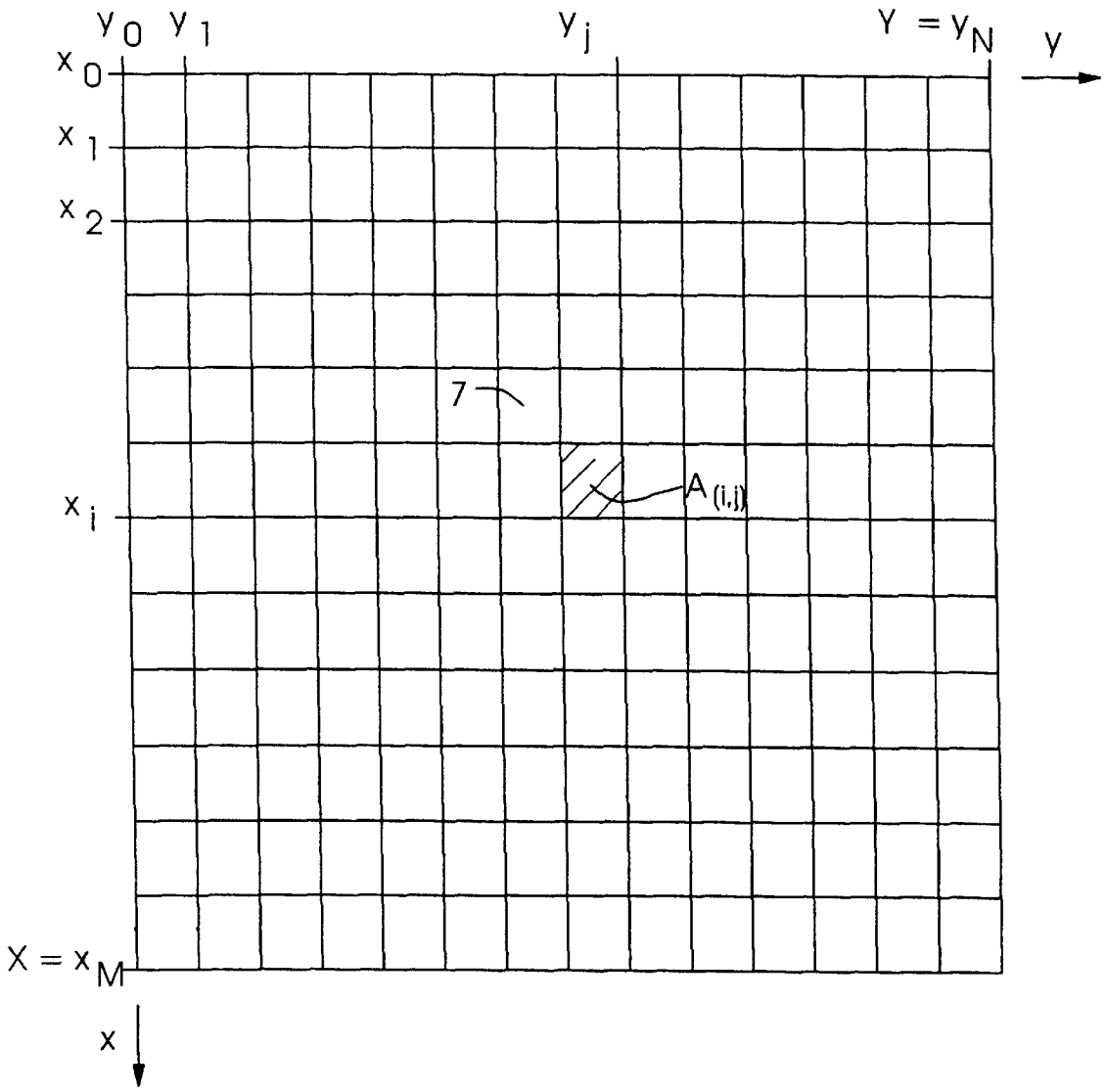
FIG. 14 is a developed view of the entire circumferential surface of the ink form roller, divided in matrix fashion into fields.

For instance, the area coverage to be made the basis of the area element designated 7 in FIG. 12, for 15 screen dot positions occupied out of 30 possible screen dot positions, is 15/30, or in other words 50%.

In conjunction with the above explanation, a simplification has been made, by assuming an equal diameter of all the screen dots within a given area element 18. If the screen dot size is variable, then naturally this is also taken into account by the computer 20 in calculating the area coverage F and the ink volume V.

In the rolling contact of the ink form roller 11, which carries an ink film of uniform ink film thickness s, with the printing form, the ink splitting already mentioned in conjunction with FIG. 1 occurs within the printing regions. The original ink film thickness s is preserved in the non-printing regions, while in the printing regions it is reduced to an ink film thickness that remains after the splitting. Multiplying the total area of the area element 7 by the area coverage F of the area element 18 to be assigned to area element 7 produces a first value. A second value is produced by subtracting the aforementioned remaining ink film thickness in the area element 7 from the original ink film thickness. The product of the multiplication of the first value by the second value is the ink volume V split off from the area element 7 onto the printing form 16, or the ink demand of the area element 7 after the splitting.

The percentage of the ink demand V of one area element 7 after the ink splitting is thus equivalent to the percentage of area coverage F of the area element 18, which element corresponds to the area element 7.

After the ink splitting, the ink volume $V_{i,j}$ that has left the area element 7, $A_{i,j}$ is resupplied to each area element 7, $A_{i,j}$ by the ink jet unit 1 again, in that the ink jet unit 1 places a single ink drop 8, 9 and 10, of a size corresponding to the respective ink demand of the area element 7, $A_{i,j}$, approximately in the center of each area element 7, $A_{i,j}$. The ink volume V of the drop 8 is enough for 9 screen dots 17, the ink volume V of the drop 9 is enough for 18 screen dots 17, and the ink volume V of the drop 10 is enough for 15 screen dots. Alternatively, however, it is also possible that instead of the drop 9, the ink jet unit 1 places 9 smaller drops of equal size in succession within a short time in the corresponding area element.

The course of the method of the invention explained with reference to FIGS. 4 through 14 can naturally be adopted readily to the inking unit shown in FIG. 2.

I claim:

1. Method for metered transferring of ink to an ink roller in a printing unit of a rotary offset printing press, which comprises:

determining digital data for effecting a two-dimensional ink distribution on a casing surface of an ink roller corresponding to an ink consumption;

providing an ink-jet unit with a plurality of ink nozzles and aligning the ink nozzles with one dimension of the two-dimensional ink distribution; and ejecting ink droplets under pressure for applying ink to the casing of the ink roller from the ink nozzles of the ink-jet unit controlled by means of a control device in accordance with the digital data.

2. A method for inking a printing form on a cylinder of a rotary offset printing press, having an inking system with an inking roller and an ink-jet printing apparatus acting across a length of the inking roller, wherein a number of ink drops that can be expelled per unit of length onto the surface of the inking roller with the ink-jet printing apparatus is substantially less than a number of screen dots generated per unit of length on the printing form, the method which comprises:

inputting into a control device signals containing an ink quantity V output per area element of a printing form onto an offset cylinder;

applying a quantity V of ink from ink-jet nozzles of the ink-jet printing apparatus under control of the control device to area elements of the surface of the inking roller corresponding to the ink quantity V output to the corresponding area element of the offset cylinder; and renewing the ink quantity output to the offset cylinder in each area element during a revolution of the printing form cylinder.

3. The method according to claim 2, which comprises providing the inking roller as an ink form roller in rolling contact with the printing form.

4. The method according to claim 2, which comprises operating the inking roller in rolling contact with an ink form roller that is in rolling contact with the printing form.

5. A method for inking a rotating printing form having a printing form surface being imaged with screen dots carrying ink during printing, which comprises:

defining a plurality of screen dots within a specific one of a plurality of area elements dividing a printing form surface;

applying ink with an inking roller having a roller surface divisible into area elements corresponding to the area elements of the printing form, one of the area elements of the inking roller being a specific area element of the inking roller;

expelling ink drops with an ink jet unit onto the inking roller, and applying a volume of the ink to the specific area element of the inking roller equivalent to an ink volume transferred away from the specific area element of the printing form in printing;

wherein the ink drops are applied by the ink jet unit onto the specific area element of the inking roller in a number substantially less than a number of screen dots located within the specific element of the printing form.

6. The method according to claim 5, wherein the inking roller is an ink form roller rolling on the printing form, and the method comprises outputting the ink directly from the specific area element of the inking roller to the one specific area element of the printing form.

7. The method according to claim 5, wherein the inking roller is disposed in rolling contact with an ink form roller, and the method comprises outputting the ink from the specific area element of the inking roller to the specific area element of the printing form indirectly via the ink form roller.

8. The method according to claim 5, which comprises applying with the ink jet unit variously metered volumes of ink on respective area elements of the inking roller, to compensate for a local ink output of the inking roller varying from one area element to another during printing.

9. The method according to claim 8, which comprises metering the volumes of ink to vary in size from one area element of the inking roller to another and expelling the ink in a different drop size for each of the area elements.

10. The method according to claim 9, which comprises applying a single drop of ink with the ink jet unit to each of the area elements.

11. The method according to claim 8, which comprises metering the volumes of ink to vary in size from one area element of the inking roller to another and expelling the ink in a different number of drops, greater in each case than zero, for each of the area elements.

12. The method according to claim 5, which comprises applying with the ink jet unit a same volume of ink to the specific area element of the inking roller after each revolution of the printing form.

13. The method according to claim 5, which comprises printing with a planographic printing form.

14. The method according to claim 5, which comprises printing with an offset printing form.

15. The method according to claim 5, wherein a number of screen dots in the specific area element of the printing form is at least 10 times a number of ink drops applied by the ink jet unit to the specific area element.

16. The method according to claim 5, wherein a number of screen dots in the specific area element of the printing form is at least 20 times a number of ink drops applied by the ink jet unit to the specific area element.

17. The method according to claim 5, wherein a number of screen dots in the specific area element of the printing form is at least 50 times a number of ink drops applied by the ink jet unit to the specific area element.

18. The method according to claim 5, wherein a number of screen dots in the specific area element of the printing form is at least 100 times a number of ink drops applied by the ink jet unit to the specific area element.

19. The method according to claim 5, which comprises supplying ink to the printing form during printing exclusively with the ink jet unit.

20. The method according to claim 5, wherein the inking roller is an ink form roller, and the method comprises placing the roller in rolling contact with at least one axially oscillating vibrator roller, downstream of the ink jet unit and upstream of the printing form in a direction of rotation of the ink form roller, and spreading the ink drop with the vibrator roller after applying the ink drop to the ink form roller with the ink jet unit prior to transferring the ink to the printing form.

21. The method according to claim 5, which comprises rotating the inking roller in rolling contact with an ink form roller, the ink form roller being in rolling contact with at least one axially oscillating vibrator roller disposed downstream of the inking roller and upstream of the printing form in a direction of rotation of the ink form is roller, and the method which comprises spreading the ink drop applied by the ink jet unit to the inking roller and transferred from the inking roller to the ink form roller, by friction before transferring the ink drop to the printing form.

* * * * *